US010633168B2

(12) United States Patent
Wolak et al.

(10) Patent No.: US 10,633,168 B2
(45) Date of Patent: Apr. 28, 2020

(54) PRESSURIZED DISPENSING SYSTEM INCLUDING A PLASTIC BOTTLE

(71) Applicant: S.C. Johnson & Son, Inc., Racine, WI (US)

(72) Inventors: Christopher P. Wolak, Racine, WI (US); Cassandra Blair, Milwaukee, WI (US); Daniel S. McGrath, Gurnee, IL (US); Niles Stenmark, Franklin, WI (US); Kimberly J. Harris, Milwaukee, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 137 days.

(21) Appl. No.: 15/367,651

(22) Filed: Dec. 2, 2016

(65) Prior Publication Data

US 2018/0155115 A1 Jun. 7, 2018

(51) Int. Cl.
*B65D 83/70* (2006.01)
*B65D 83/38* (2006.01)

(52) U.S. Cl.
CPC ..... *B65D 83/70* (2013.01); *B65D 83/38* (2013.01)

(58) Field of Classification Search
CPC ..... B65D 83/70; B65D 83/38; B05B 9/0822; B29C 49/04; Y10T 137/7888
USPC ..... 222/394, 397
See application file for complete search history.

(56) References Cited

U.S. PATENT DOCUMENTS

| | | | | |
|---|---|---|---|---|
| 5,052,577 | A * | 10/1991 | Cuns-Rial | B65D 83/38 215/327 |
| 5,199,615 | A | 4/1993 | Downing et al. | |
| 5,460,300 | A * | 10/1995 | Tritsch | B05B 9/0822 222/401 |
| 7,279,207 | B2 | 10/2007 | Darr | |
| 2012/0241457 | A1* | 9/2012 | Hallman | B65D 83/38 220/309.1 |
| 2016/0288986 | A1* | 10/2016 | Patel | B65D 83/38 |

FOREIGN PATENT DOCUMENTS

| | | | |
|---|---|---|---|
| CA | 2 545 057 | C | 7/2005 |
| EP | 2 517 968 | A1 | 10/2004 |
| EP | 1 352 730 | B1 | 6/2006 |

(Continued)

OTHER PUBLICATIONS

International Search Report and Written Opinion dated Feb. 26, 2018, issued in International Patent Application No. PCT/US2017/063826.

*Primary Examiner* — Paul R Durand
*Assistant Examiner* — Robert K Nichols, II

(57) ABSTRACT

A pressurized dispensing system includes a plastic bottle. The plastic bottle includes a crimp ring extending outwardly from a finish of the bottle, with first and second sealing projections extending from an upper surface of the crimp ring. A slot extends inwardly from an outer surface of the crimp ring, with the slot including a first section adjacent to the upper surface that is a further distance from an axis of the bottle than the second sealing projection is positioned from the axis of the bottle. The slot forms a passageway for gas to be released from the bottle when the system is heated. A valve is crimped to the crimp ring and a gasket is positioned between the upper surface and the valve such that a seal is formed between the bottle and valve.

8 Claims, 9 Drawing Sheets

(56) References Cited

FOREIGN PATENT DOCUMENTS

| | | | | |
|---|---|---|---|---|
| GB | 2 205 614 | A | | 12/1988 |
| JP | 2004099180 | A | * | 4/2004 |
| JP | 2005-162231 | A | | 6/2005 |
| JP | 2013-249073 | A | | 12/2013 |
| JP | 2013-249074 | A | | 12/2013 |
| WO | 2011/090457 | A1 | | 7/2011 |

* cited by examiner

PRESSURIZED DISPENSING SYSTEM INCLUDING A PLASTIC BOTTLE

BACKGROUND

Field of the Invention

Our invention generally relates to a pressurized dispensing system that includes a plastic bottle. Such a system can be used to dispense, for example, an aerosol spray. More specifically, our invention relates to a dispensing system that includes a plastic bottle for containing a product under pressure, with the bottle finish including slots to allow gas to escape in a controlled manner when the bottle is exposed to an elevated temperature, and the bottle being effectively sealed at non-elevated temperatures (e.g., room temperature).

Related Art

Pressurized dispensing systems, such as systems used to dispense aerosol products, have conventionally included metallic (e.g., steel or aluminum) containers for containing the product under pressure before it is dispensed from the system. Examples of products that are dispensed with such systems include air fresheners, fabric fresheners, insect repellants, paints, body sprays, hair sprays, shoe or footwear spray products, whipped cream, and processed cheese. Recently, there has been increased interest in using plastic bottles as an alternative to metallic containers in pressurized dispensing systems because plastic bottles have several potential advantages. For example, plastic bottles may be easier and cheaper to manufacture than metallic containers, and plastic bottles can be made in a wider variety of interesting shapes than metallic containers.

When a pressurized dispensing system is heated, the pressure inside of the system's container increases and/or the volume of the container increases. In systems that use a plastic bottle for containing the product, exposure of the system to an elevated temperature (e.g., 70° C. for a plastic bottle made from polyethylene terephthalate (PET)) can cause an increase in the volume of the bottle. The increased volume may not be evenly distributed symmetrically throughout the bottle. For example, the plastic bottle may bulge outward in some areas, while not bulging in other areas. This bulging in the plastic bottle can lead to a potentially hazardous condition where the bottle contorts in such a way that a valve becomes less firmly attached to the bottle. Eventually, as the bottle contorts more and more, the valve may detach from the top of the bottle, becoming a projectile, which might injure a person in the vicinity of the bottle.

U.S. Pat. No. 5,199,615 discloses an aerosol dispenser including a plastic bottle having a pressure relief mechanism designed to help alleviate the problem of a valve detaching from the bottle when the dispenser is exposed to an elevated temperature. In particular, the finish of the bottle, to which a valve is attached, is provided with a plurality of slots. The bottle and valve are configured such that when the bottle is heated a pathway is created through the slots to outside of the dispenser. The pathway allows for gas inside of the bottle to rapidly discharge, thereby relieving pressure, so that the valve does not detach from the top of the bottle.

While the pressure relief slots in U.S. Pat. No. 5,199,615 may reduce the possibility of the valve detaching from the top of the bottle when the system is heated, we have found that the configurations of the slots shown in that patent result in an ineffective seal being formed between the bottle and valve. As such, any minor imperfection in the finish could cause gas from inside the bottle to leak from the system. Notably, there could be a significant pressure drop in a matter of minutes. This is very undesirable as pressurized dispensing systems are often used for products that have a shelf-life of multiple years.

SUMMARY OF THE INVENTION

According to one aspect, our invention provides an aerosol system with a plastic bottle including a base at a bottom end of the bottle, a body extending about an axis of the bottle from the base towards a top end of the bottle, and a finish extending about the axis of the bottle from the body to the top end of the bottle. The finish includes a crimp ring extending outwardly from an adjacent surface of the finish, with the crimp ring forming an upper surface of the bottle and an outer surface of the bottle. The finish also includes a first sealing projection extending from the upper surface, and a second sealing projection extending from the upper surface, with the second sealing projection being positioned a further distance from the axis of the bottle than the first sealing projection is positioned from the axis of the bottle. At least one slot extends inwardly from the outer surface, with the at least one slot including a first section adjacent to the upper surface that is a further distance from the axis of the bottle than the second sealing projection is positioned from the axis of the bottle, and the at least one slot includes a second section that is the same distance from the axis as the adjacent surface of the finish. A valve is crimped to the crimp ring, and a gasket is positioned between the upper surface and the valve such that a seal is formed between the bottle and the valve.

According to another aspect, our invention provides an aerosol system having a plastic bottle that includes a base at a bottom end of the bottle, a body extending about an axis of the bottle from the base towards a top end of the bottle, and a finish extending about the axis of the bottle from the body to the top end of the bottle. The finish includes a crimp ring extending outwardly from an adjacent surface of the finish, with the crimp ring forming an upper surface of the bottle and an outer surface of the bottle. The finish also includes a first sealing projection extending from the upper surface, and a second sealing projection extending from the upper surface, with the second sealing projection being positioned a further distance from the axis of the bottle than the first sealing projection is positioned from the axis of the bottle. At least one slot extends inwardly from the outer surface, the at least one slot including a first section extending from the upper surface, and a second section below the first section, with the second section being a shorter distance from the axis of the bottle than the first section is distanced from the axis of the bottle. A valve extends about the crimp ring, and a gasket is positioned between the upper surface and the valve to thereby seal the bottle.

DETAILED DESCRIPTION OF THE INVENTION

Our invention generally relates to a pressurized dispensing system that includes a plastic bottle. More specifically, our invention relates to a dispensing system that includes a plastic bottle for containing a product under pressure, with the bottle finish including slots to allow gas to escape in a controlled manner when the bottle is exposed to an elevated temperature, and the bottle being effectively sealed at non-elevated temperatures (e.g., room temperature).

In the descriptions that follow, we will sometimes explain features of our invention in the specific context of an aerosol dispensing system. Those skilled in the art will readily appreciate, however, that our invention is not limited to use with aerosol products. Rather, the pressurized dispensing systems described herein could alternatively be used in conjunction with products other than aerosols. For example, the dispensing systems described herein might be used to dispense foam products such as shaving cream or soap, or used to dispense food products such as soda, whipped cream, or processed cheese.

Figure 1:
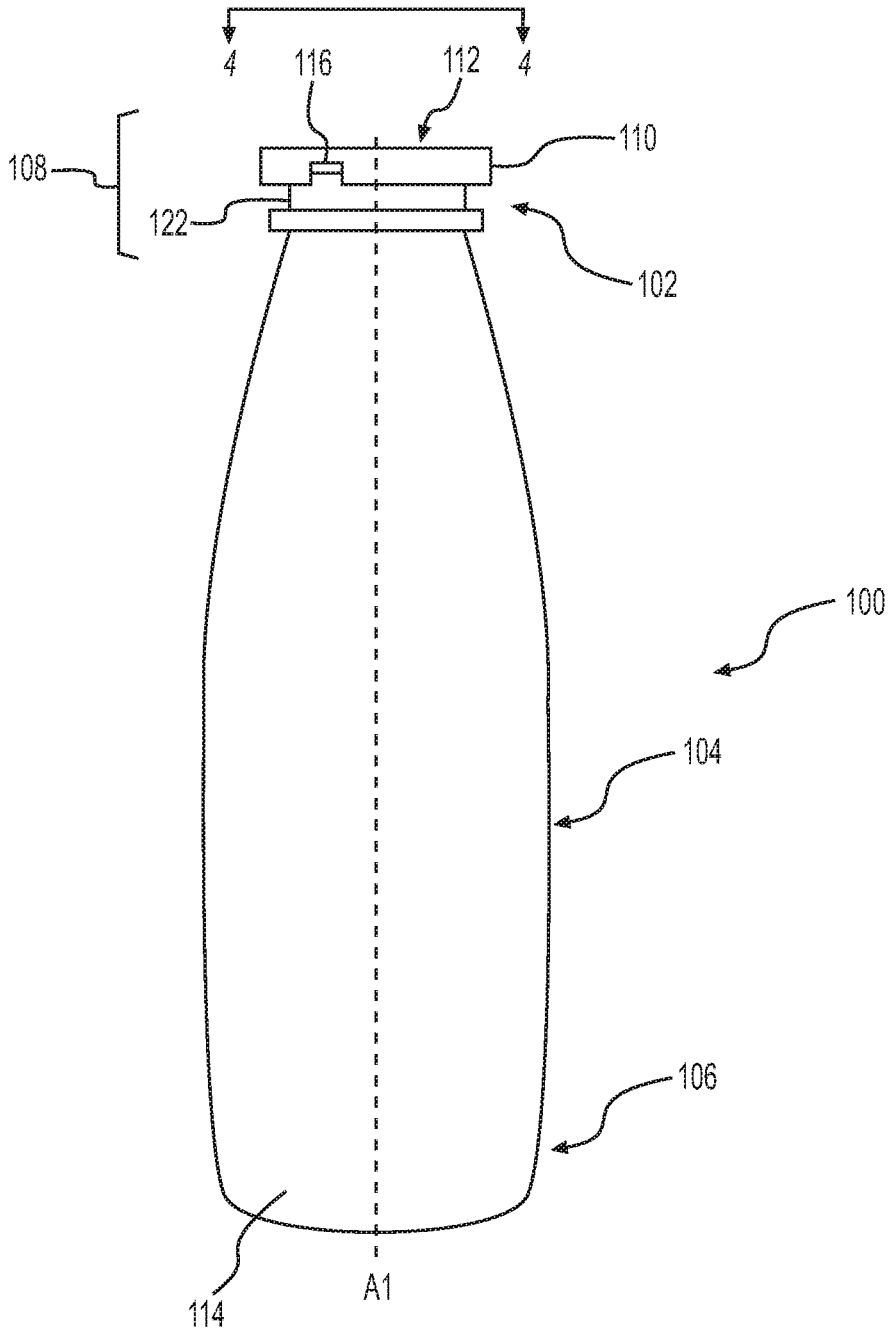
FIG. 1 is a side view of a bottle according to an embodiment of our invention.

FIG. 1 shows a bottle 100 for dispensing an aerosol product according to an embodiment of our invention. For clarity, this figure does not include some of the components that would be a part of a complete dispensing system that includes the bottle 100. For example, a spray mechanism is not shown at the top of the bottle 100 in FIG. 1, nor does the bottle 100 include a structure at the bottom (e.g., a base cup) that allows the bottle 100 to stand upright. A more complete description of a dispensing system using the bottle 100 will be described below.

The bottle 100 in this embodiment is made from a plastic material. As such, the bottle 100 may be formed using, for example, injection, compression, and/or blow molding techniques, which are well known in the art. In injection and blow molding processes, a plastic preform is first formed using injection molding. The plastic preform is subsequently heated and stretch blow molded into the final shape of the bottle 100. Some examples of such plastics include branched or linear PET, polycarbonate (PC), polyethylene naphthalate (PEN), nylon, polyethylene furanoate (PEF), polyolefins (PO) such as polyethylene (PE) and polypropylene (PP), and other polyesters, and blends thereof. It should be noted that the shape, size, and proportions of the bottle 100 shown in FIG. 1 are merely exemplary. Indeed, one of the advantages of using plastic to form the bottle 100 is that the plastic may be molded into a wide variety of shapes and sizes.

The bottle 100 includes an upper end 102, a lower end 106, and a body 104 between the upper and lower ends 102 and 106. In this embodiment, the body 104 of the bottle 100 is round and extends about an axis A1. The upper end 102 includes a finish 108 having a crimp ring 110 surrounding an opening 112 of the bottle 100. As will be explained in detail below, a pressure relief slot 116 is provided in the crimp ring 110, and a valve (not shown) can be crimped to the crimp ring 110 in order to securely attach the valve to the bottle 100. In the particular bottle 100 shown in FIG. 1, the body 104 slightly bows outward from the axis A1 towards the lower end 106 of the bottle 100. In other embodiments, however, the body 104 of the bottle 100 is formed in different shapes. For example, the bottle 100 may be cylindrical through the length of the body 104. A rounded bottom 114 is formed at the lower end 106 the bottle 100. An additional structure (e.g., a base cup) can be provided to the rounded bottom 114 in order to allow the bottle 100 to stand upright. But, in other embodiments, the bottom 114 of the bottle 100 may be formed in a different shape so that the bottle can stand upright without the provision of an additional structure attached to the bottom 114.

Figure 2:
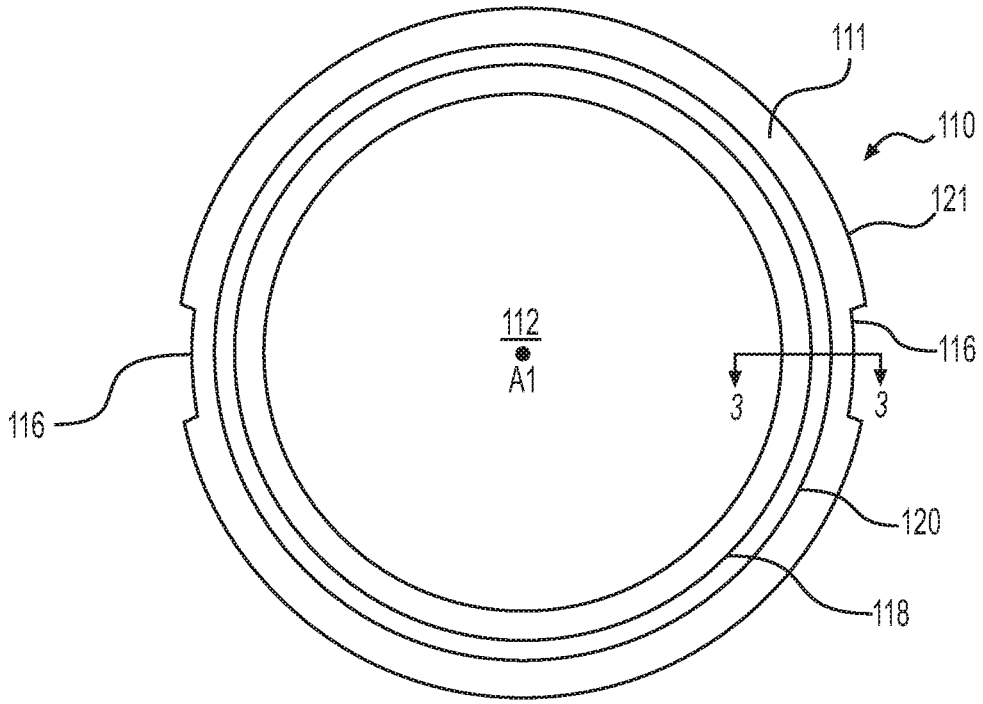
FIG. 2 is a top view of the bottle shown in FIG. 1.

FIG. 2 is a top view of the bottle 100. In this figure, details of the upper surface 111 of the crimp ring 110 can be seen. Extending from the upper surface 111 is a first sealing ring 118 and a second sealing ring 120. As will be explained more fully below, the sealing rings 118 and 120 engage a gasket when a valve is crimped to the bottle 100, which thereby creates a seal that prevents contents from leaking out of the bottle 100. Having two sealing rings 118 and 120 ensures that an adequate seal is formed even if there are any imperfections in one of the sealing rings 118 and 120. As can also be seen in FIG. 2, two pressure relief slots 116 are formed in the crimp ring 110, with the two pressure relief slots 116 being positioned on opposite sides of the bottle 100. Notably, while the pressure relief slots 116 extend from an outer surface 121 of the crimp ring 110 inward toward the axis A1 of the bottle 100, the pressure relief slots 116 do not extend to positions that are closer to the axis A1 than the second sealing ring 120 is positioned from the axis A1. Thus, the second sealing ring 120 extends completely around the upper surface 111 and is not interrupted by the pressure relief slots 116.

The embodiment of the bottle 100 shown in FIG. 2 includes two pressure relief slots 116. The number of pressure relief slots 116 may vary, for example, from two to four, in different embodiments. Still other embodiments of our invention may include only one pressure relief slot 116 formed in the crimp ring 110 while still achieving the pressure relief effects described herein. While in other embodiments, the bottle 100 may have more than four pressure relief slots 116, such as a bottle having six pressure relief slots 116 in another embodiment. Also, when two or more pressure relief slots 116 are used, the pressure relief slots 116 can be provided at different positions on the crimp ring 110, with the pressure relief slots 116 not necessarily being equidistant from each other.

Figure 3:
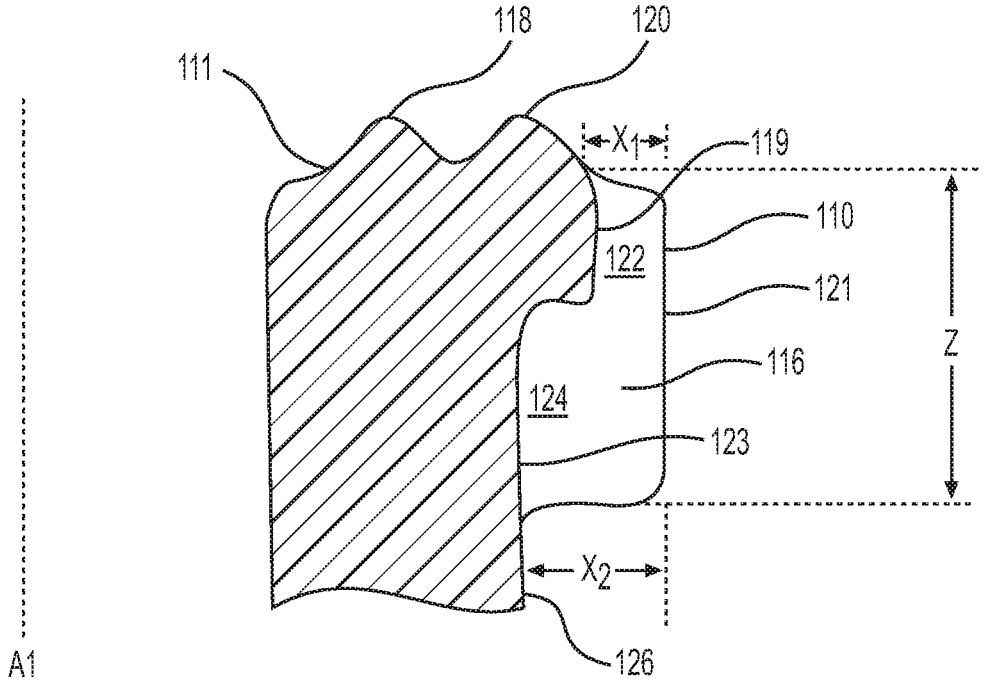
FIG. 3 is a cross-sectional view of a portion of the finish of the bottle shown in FIGS. 1 and 2, as taken along line 3-3 shown in FIG. 2.

FIG. 3 is a cross-sectional view taken through one of the pressure relief slots 116 shown in FIGS. 1 and 2. A first section 122 of the pressure relief slot 116 extends a distance x1 from the outer surface 121 towards the axis A1 of the bottle 100. Below the first section 122, a second section 124 extends a distance x2 from the outer surface 121 towards the axis A1. The pressure relief slot 116 is configured such that the distance x2 is greater than the distance x1, thus, a distinct step is formed in the slot 116. Further, the first section 122 of the pressure relief slot 116 extends less than half of the height z of the slot 116, while the second section 124 extends more than half of the height z of the slot. As will be further explained below, we have found that this configuration of the pressure relief slot 116 with the first and second sections 122 and 124 allows for a passageway to be opened such that gas can be effectively released from a pressurized system using the bottle 100 when the system is heated to an elevated temperature. Also, as shown in both FIG. 2 and FIG. 3, the surface 119 of the bottle 100 within the first section 122 of the pressure relief slot 116 is positioned further from the axis A1 of the bottle 100 than the second sealing projection 120. That is, the first section 122 of the pressure relief slot 116 is not formed into the crimp ring 110 such that any part of the second sealing projection 120 is removed. This is a significant feature of our invention because the second sealing projection 120 is important in forming a good seal between the bottle 100 and a valve crimped to the crimp ring 110. Thus, with the configuration of the pressure relief slot 116 shown in FIG. 3, a system can be created that is both well sealed and has a mechanism for alleviating pressure inside the bottle 100 when the system is excessively heated.

Other aspects of the pressure relief slot 116 are shown in FIG. 3. For example, the second section 124 is formed such that the surface 123 of the bottle 100 in the second section 124 is the same distance from the axis A1 as the adjacent surface 126 of the bottle 100. It should be noted, however, that in other embodiments, the second section 124 is formed at a different distance from the axis A1 than the adjacent surface 126 such that a second distinct step is formed within the pressure relief slot 116. And, those skilled in the art will appreciate that the two-section pressure relief slot 116 depicted in FIG. 3 could be varied in other ways while still achieving the pressure relief and sealing features described herein.

Figure 4:
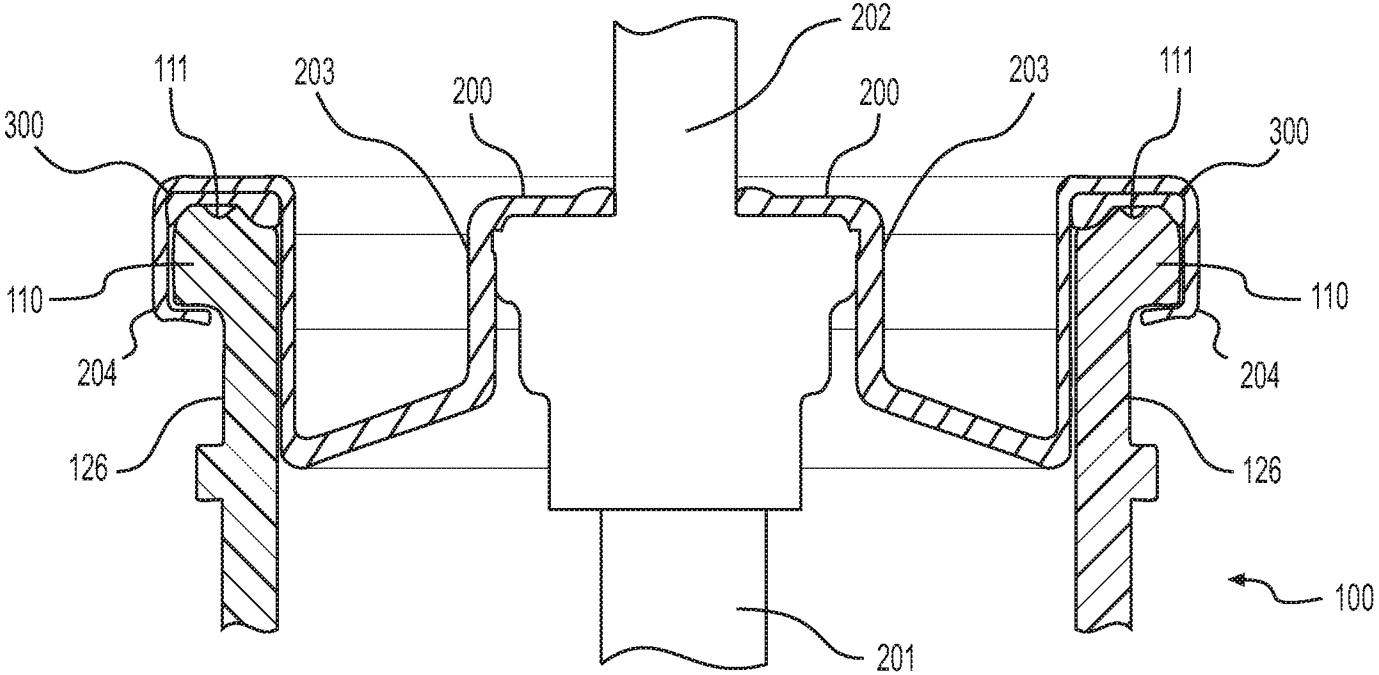
FIG. 4 is a cross-sectional view of a valve crimped to the finish of the bottle shown in FIG. 1, with the cross section being taken along line 4-4 shown in FIG. 1.

FIG. 4 shows the finish of the bottle 100 along with a valve 200 crimped to the crimp ring 110. The valve 200 includes a trigger mechanism 202 connected to a dip tube 201 that extends down into the bottle 100. In a system with bottle 100 and valve 200, product in the bottle 100 moves through the dip tube 201 and trigger mechanism 202 as it is discharged from the system. The trigger mechanism 202 and dip tube 201 are well known in the art and therefore not shown in detail in FIG. 4.

The valve 200 includes a cup 203 that is set to the opening at the top end 102 of the bottle 100. An outer portion 204 of the cup 203 extends over the upper surface 111 and around the crimp ring 110 of the bottle 100. The valve 200 is thereby firmly attached to the bottle 100. More specifically, with this crimping of the valve 200 to the crimp ring 110, the valve 200 is securely attached to the bottle 100 so that the valve 200 will remain in place when the bottle is pressurized with a product. To create a tight seal between the bottle 100 and the valve 200, a gasket 300 is positioned between the top surface 111 of the crimp ring 110 and the valve 200, with the gasket 300 being compressed when the valve 200 is crimped to the crimp ring 110. This tight seal is sufficient to maintain the pressure inside the bottle over a long time.

Figure 5:
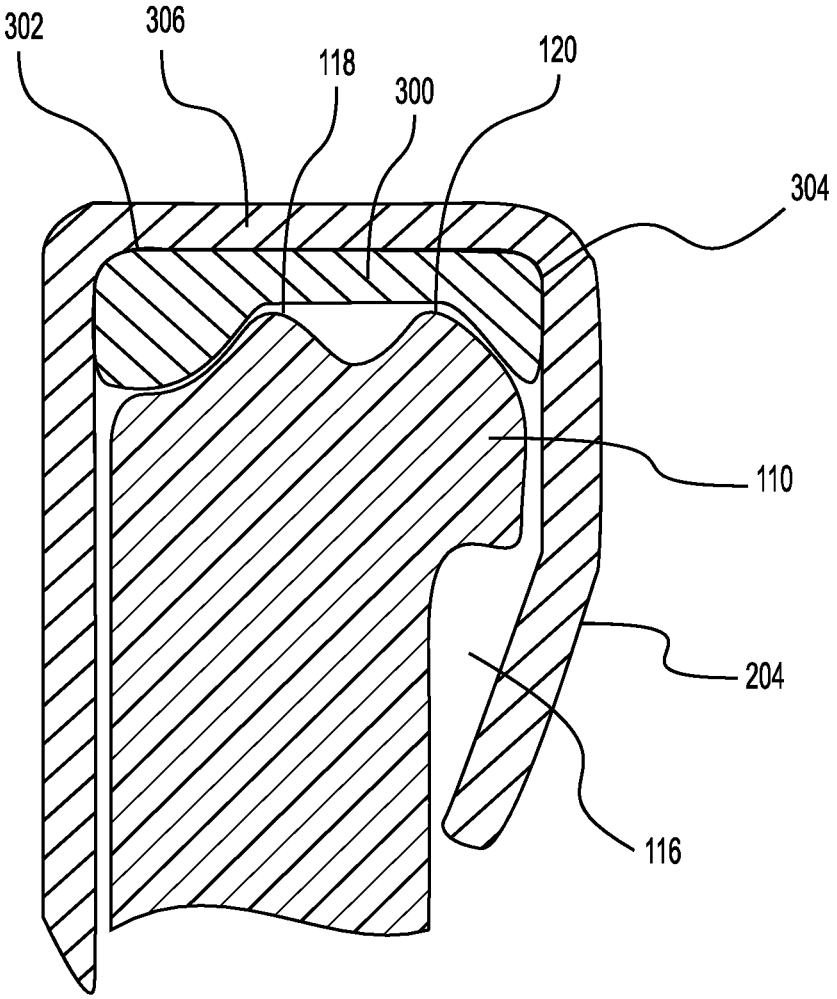
FIG. 5 is a detailed view of the valve crimped to the finish shown in FIG. 4 as seen through a part of the finish portion that includes a pressure relief slot.

FIG. 5 is a cross-sectional view of a portion of the finish 108 of the bottle 100 with the pressure relief slot 116 and the crimped valve 200. Because of the stepped, two-section configuration of the pressure relief slot 116, the second sealing projection 120 is present at a position adjacent to the slot 116 and engaged to the gasket 300. Further, the gasket 300 is configured so as to contact the first sealing projection 118, a first (inside) surface 302 of the valve 200, a second (outside) surface 304 of the valve 200, and the full length of a surface 306 of the valve 200 that extends between the first surface 302 and the second surface 304. In other words, the gasket 300 fills almost all of the space between the upper surface 111 of the crimp ring 110 and the valve 200. We have found that in order to maintain the pressure inside the bottle 100 over an extended period of time (e.g., many months), it is necessary to have the gasket 300 substantially fill the space between the crimp ring 110 and the valve 200, and to have the gasket 300 engaged to both the first sealing projection 118 and the second sealing projection 120 all the way around the upper surface 111 of the crimp ring 110. And, as discussed above, the configuration of the pressure relief slots 116 according to our invention is such that no part of the second sealing projection 120 is removed by the pressure relief slots 116. Thus, the bottle 100 according to our invention is provided with the pressure relief slots 116 without disrupting the seal between the bottle 100 and valve 200.

In particular embodiments of our invention, the gasket 300 is a butyl gasket, which we have found to work well because of the compressible nature of such a gasket. Those skill in the art will recognize, however, that other types of gaskets might be used. For example, the gasket 300 could be made from rubber, buna, neoprene, EPDM rubber, fluorocarbons, nitriles, polypropylene, or polyethylene.

Figure 6B:
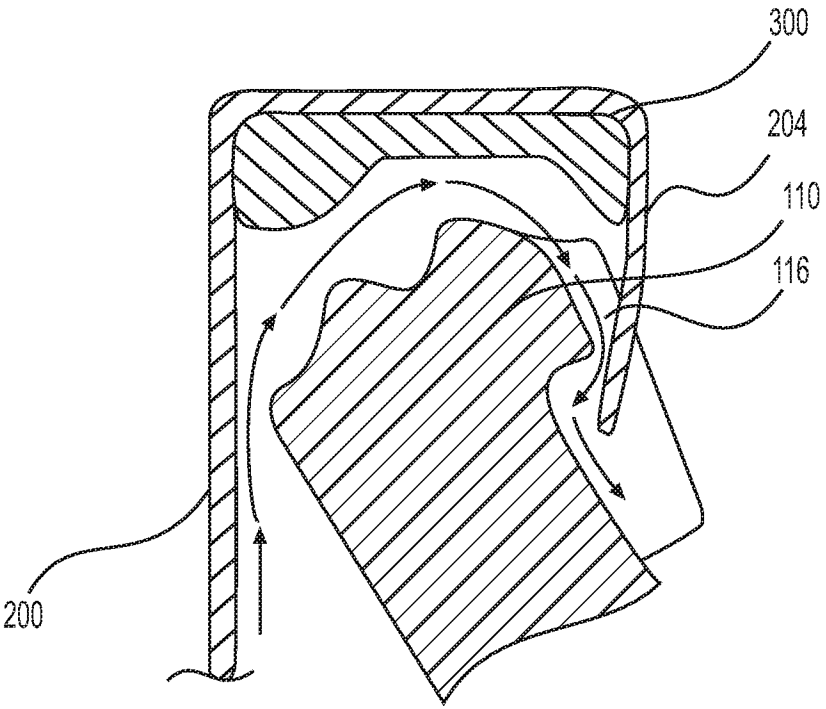
FIGS. 6A and 6B are cross-sectional views of portions of the finish and crimped valve as shown in FIGS. 4 and 5 when the bottle is exposed to an elevated temperature.
Figure 6A:
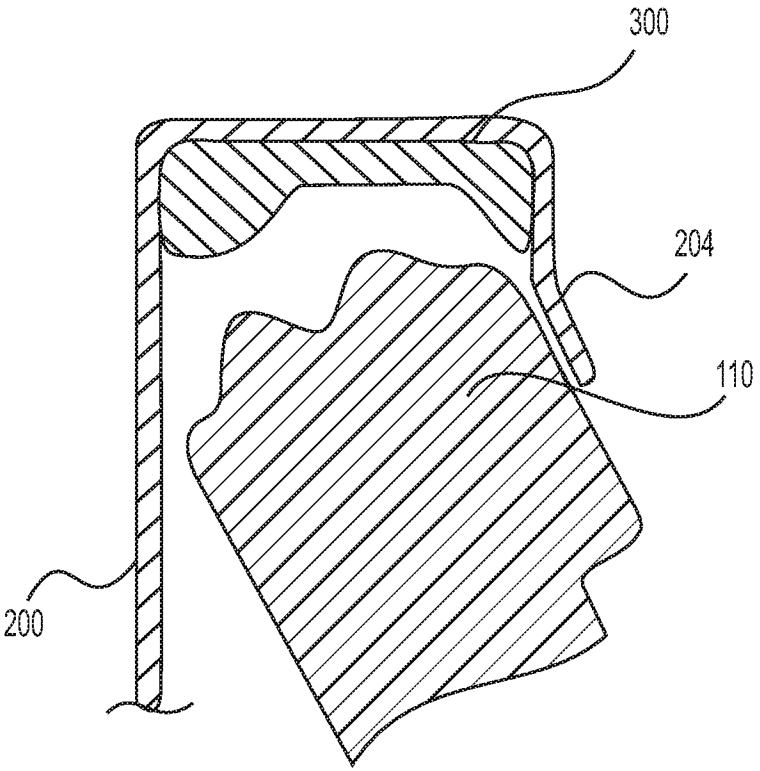

FIGS. 6A and 6B are views of portions of the finish 108 and crimped valve 200 showing a condition where the bottle 100 is exposed to an elevated temperature. When referring an "elevated temperature" herein, we mean a temperature at or slightly below the heat deflection temperature of the bottle. As will be appreciated by those skilled in the art, the heat deflection temperature of a plastic material is the temperature at which the plastic deforms under a specific load. The heat deflection temperature can be determined, for example, by ASTM D648 or ISO 75 standards. As will also be appreciated by those skilled in the art, a plastic material will actually start to move at temperatures slightly below the heat deflection temperature, and the heat deflection temperature will vary depending on the particular type of plastic and how the plastic has been processed. Thus, an "elevated temperature" of a bottle herein will be a temperature slightly below the heat deflection temperature where the plastic material of a bottle begins to move. And, a "non-elevated temperature," as used herein, means temperatures below the elevated temperature where plastic movement begins. Generally speaking, in embodiments of our invention when the bottle 100 is made of plastic material such as PET and pressurized to about 140 PSIG, the bottle may contort to such a position when exposed to an elevated temperature of about 70° C. or above for time of 2 hours or more. As discussed above, this contortion in the finish 108 of the bottle 100 occurs because, as the plastic bottle 100 is heated, portions of the plastic bottle 100 below will bulge outward. The expansion is often particularly acute in portions of the bottle 100 right below the finish 108. Thus, the finish 108 contorts, as generally shown in FIGS. 6A and 6B. Absent some sort of pressure relief mechanism whereby gas is discharged from inside of the bottle 100, it can be seen that as the bottle 100 continues to bulge outward, there will come a point where the finish 108 is so contorted that the valve 200 becomes detached from the crimp ring 110. This is potentially a hazardous condition because the high pressure inside the bottle 100 may cause the valve 200 to become detached from the top of the bottle 100. But, with our invention, the potentially hazardous condition can be averted in most cases because, as shown in FIG. 6B, the pressure relief slots 116 in the crimp ring 110 are configured so that a path (as indicated by the arrows) is created for gas to escape the inside of the bottle 100. The gas is thereby discharged from the system through the path while the valve 200 is still attached. That is, the pressure in the bottle 100 is discharged in a controlled manner and the valve 200 remains attached to the bottle 100, even at significantly elevated temperatures.

Figure 7:
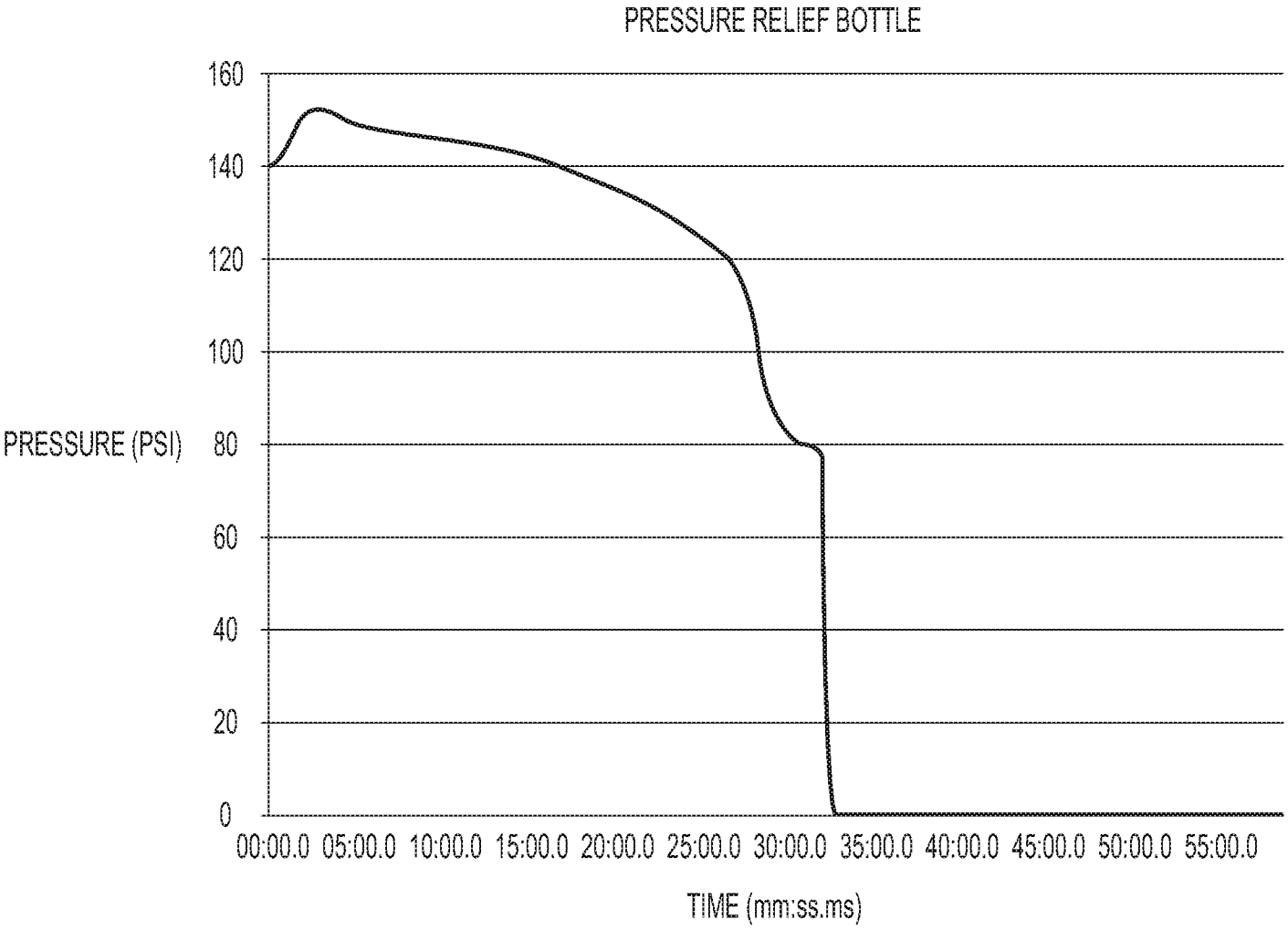
FIG. 7 shows the results of a test with a bottle according to an embodiment of our invention.

FIG. 7 shows the results of a pressure relief test that we conducted using a plastic bottle according to an embodiment of our invention. The tested bottle was made from PET and configured as described above, with two pressure relief slots and a valve crimped to the top of the bottle. The tested bottle had a volume of 296.4 mL and was filled with deionized water and nitrogen to the point where an internal pressure of 140 PSIG was reached. During the test, the bottle was heated to a temperature of 75° C. The graph in FIG. 7 shows the pressure in the bottle over the time the bottle was heated. During the first few minutes of the test, there was a slight initial rise in pressure inside of the bottle, followed by a gradual pressure decrease over the course of about 30 minutes. Without being bound by theory, we believe that the initial rise in pressure was due to the gas in the bottle being heated. As the test continued, the temperature of the bottle increased. The increased heat energy in the bottle caused movement of the PET polymers making up the bottle, which created more free volume between the chains of polymers. With the additional free volume, the pressure inside of the bottle caused the polymer chains to move and the bottle expanded. And with the expansion of the bottle the pressure decreased as the test continued. When the pressure reached about 80 PSIG, there was a quick drop in pressure. This pressure fall off below about 80 PSIG occurred because the bottle had contorted to a point that the passageways formed by the pressure relief slots were open and gas from inside of the bottle was discharged through the passageways. Importantly, during the entire test, the valve remained attached to the top of the bottle. Thus, while the pressure release from about 80 PSIG to zero occurred relatively quickly, this pressure drop to zero was not instantaneous, as would have been the case if the valve had detached from the top of the bottle.

Figure 8:
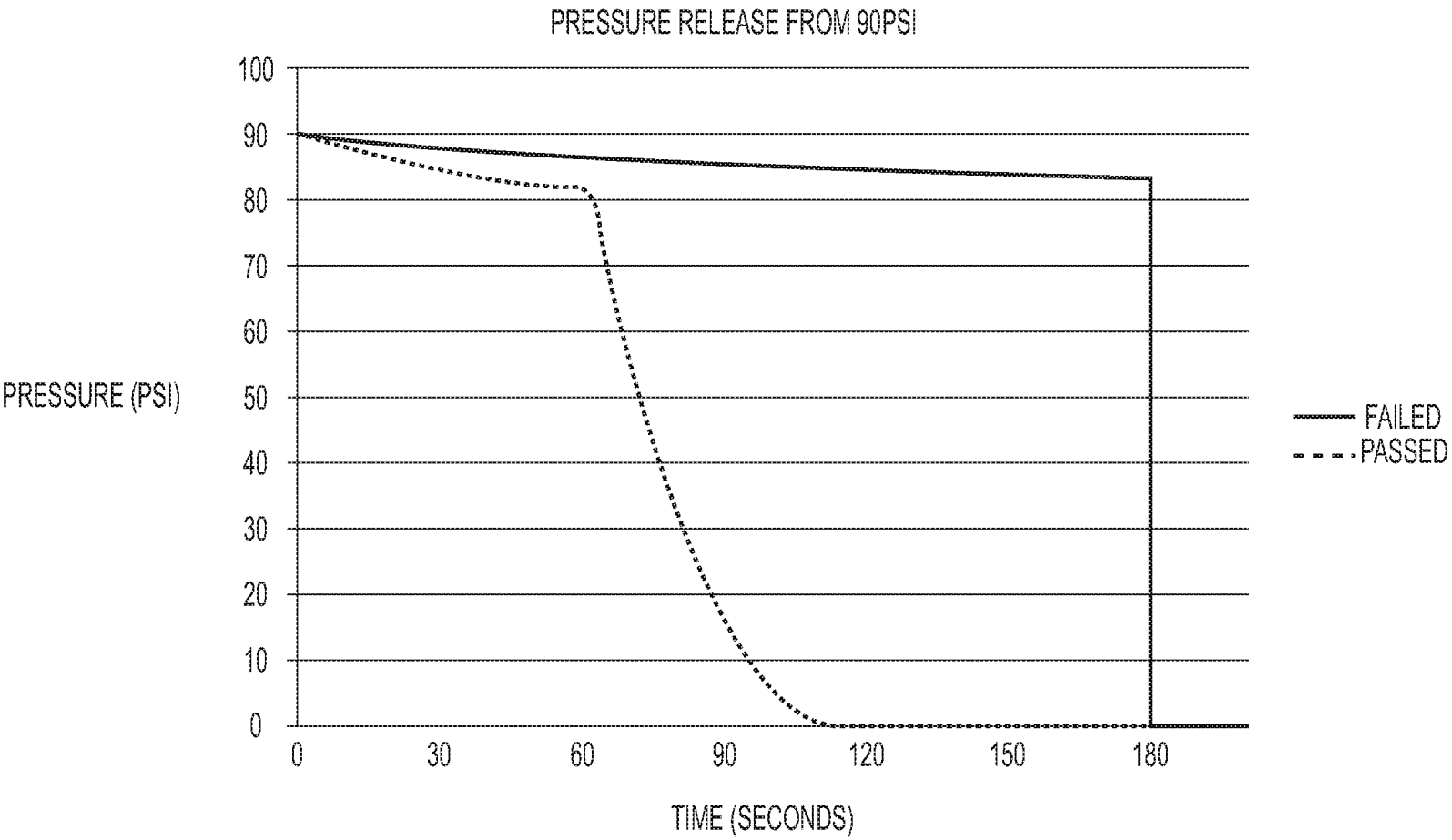
FIG. 8 shows the results of a test with a bottle according to an embodiment of our invention and a comparison bottle.

FIG. 8 shows the results of tests that compared a plastic bottle having pressure relief slots as described herein to a plastic bottle that did not have any pressure relief slots. In these tests, the bottles each had a volume of 296.4 mL and were initially pressurized with nitrogen to 140 PSIG. The bottles were then heated to a temperature of 75° C. As shown in FIG. 8, the pressure inside of the bottle with no pressure relief slots at first slightly decreased. But, when the pressure reached 83 PSIG, the valve was blown off of the top of the bottle and the pressure suddenly decreased to zero. On the other hand, in the bottle according to our invention, the pressure moderately fell from 90 PSIG to about 81 PSIG. At that point, the bottle had contorted to the point that the pressure relief passageways were open, so that the gas from the bottle was discharged. But, even with the pressure relief passageways open, it still took more than 50 seconds for the pressure to completely drop to zero. During this entire time, the valve remained attached to the bottle.

Figure 9:
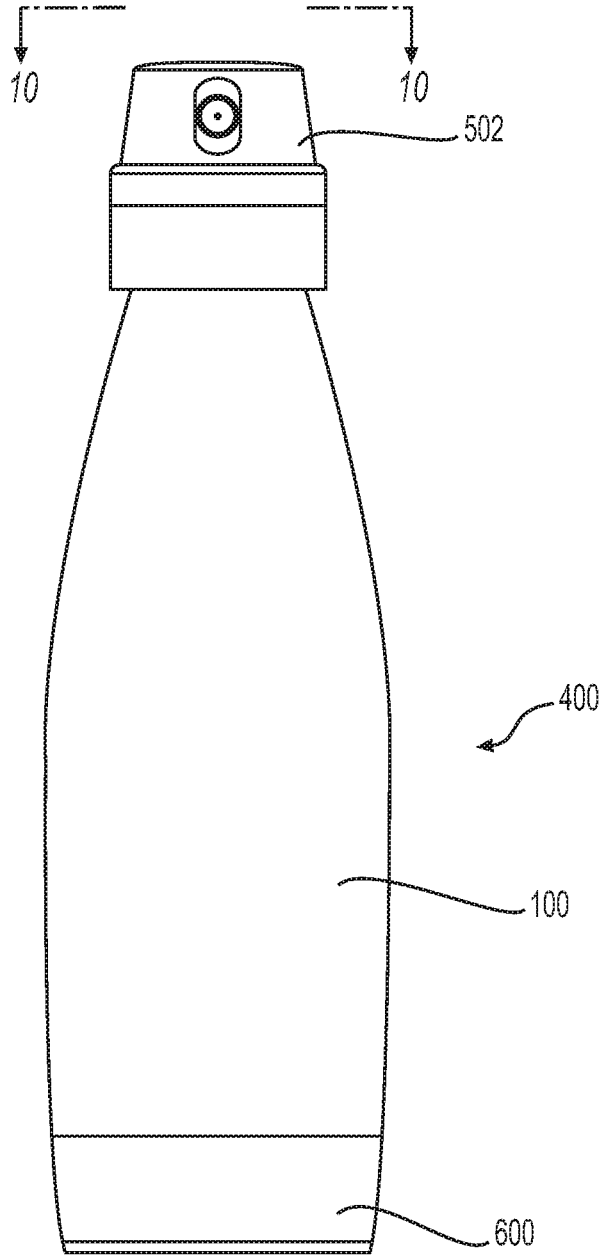
FIG. 9 is a side view of a pressurized dispensing system according to an embodiment of our invention.
Figure 10:
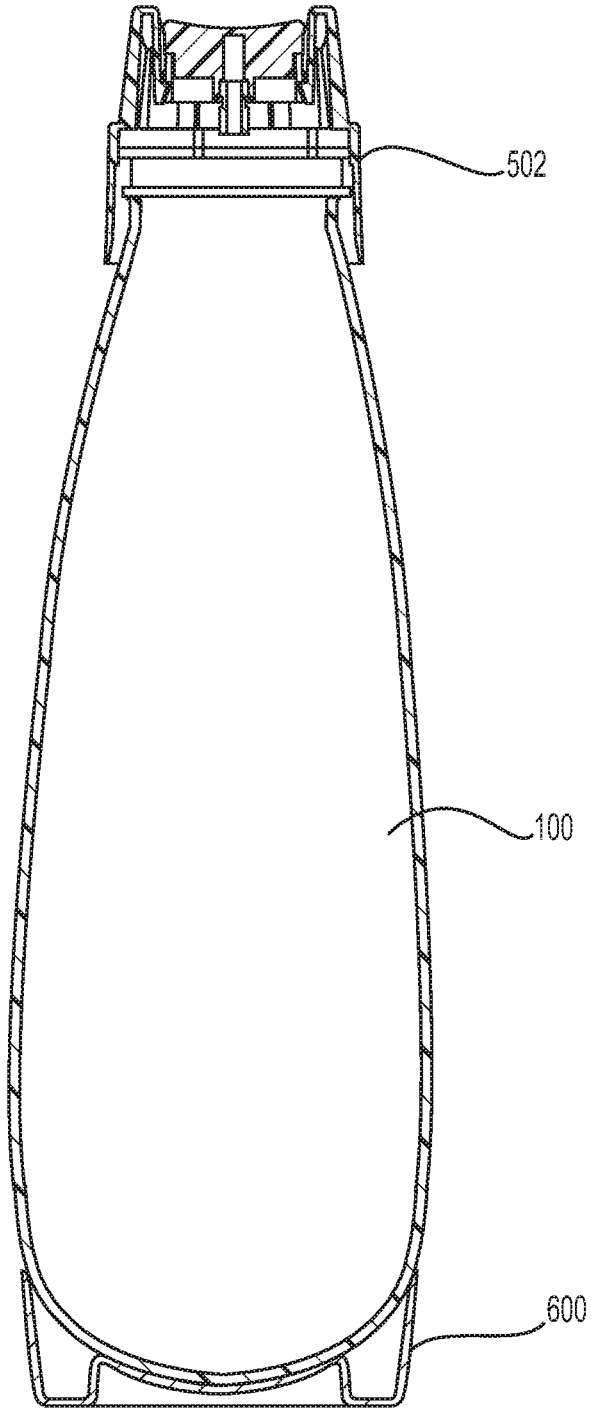
FIG. 10 is a cross-sectional view of the pressurized dispensing system shown in FIG. 9 as taken along line 10-10.

An example of a high-pressure dispensing system 400 using the plastic bottle 100 is shown in FIGS. 9 and 10. In the system 400, the rounded bottom 114 of the bottle 100 is attached to a base cup 600. Details of the base cup 600 and how the base cup 600 is attached to the bottle 100 can be found in U.S. patent application Ser. No. 15/166,337, which is hereby incorporated by reference in its entirety. The base cup 600 allows the system 400 to stand upright on a flat surface despite the bottle 100 having a rounded bottom 114. At the top of the system 400 is a spray mechanism 502, which includes a valve 200 as discussed above. The pressurized product contained within the bottle 100 is dispensed through the spray mechanism 502. Although not shown, a cap may be provided over the spray mechanism 502.

In a specific embodiment of our invention, the system 400 is used to dispense an air freshening composition. Examples of formulations for the air freshening composition can be found in U.S. patent application Ser. No. 15/094,542, which is hereby incorporated by reference in its entirety.

Although this invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

INDUSTRIAL APPLICABILITY

The invention described herein can be used in the commercial production of a pressurized dispensing system. Such pressurized dispensing systems have a wide variety of uses, for example, in the market of aerosol products.

We claim:

1. A pressurized dispensing system comprising:

(A) a plastic bottle including:

(a) a base at a bottom end of the bottle;

(b) a body extending about an axis of the bottle from the base towards a top end of the bottle; and (c) a finish extending about the axis of the bottle from the body to the top end of the bottle, wherein the finish includes:

(i) a crimp ring extending outwardly from an adjacent surface of the finish, the crimp ring forming an upper surface of the bottle and an outer surface of the bottle;

(ii) a first sealing projection extending from the upper surface; and (iii) a second sealing projection extending from the upper surface, the second sealing projection being positioned a further distance from the axis of the bottle than the first sealing projection is positioned from the axis of the bottle, wherein at least one slot extends inwardly from the outer surface, the at least one slot including a first section adjacent to the upper surface, with a surface of the bottle in the first section being a further distance from the axis of the bottle than the second sealing projection is positioned from the axis of the bottle, and the at least one slot including a second section below the first section, with a surface of the bottle in the second section being continuous with the adjacent surface of the finish;

(B) a valve crimped to the crimp ring; and (C) a gasket positioned between the upper surface and the valve such that a seal is formed between the bottle and valve.

2. The pressurized dispensing system according to claim 1, wherein the gasket is compressed so as to substantially fill the space between the upper surface and the valve.

3. The pressurized dispensing system according to claim 2, wherein the compressed gasket contacts the first sealing projection, the second sealing projection, a first surface of the valve, a second surface of the valve that is positioned opposite to the first surface of the valve, and a full length of a surface of the valve that spans between the first and second surfaces.

4. The pressurized dispensing system according to claim 1, wherein the gasket is a butyl gasket.

5. The pressurized dispensing system according to claim 1, wherein the second sealing projection includes a portion that is the same distance from the axis as the adjacent surface of the finish is distanced from the axis.

6. The pressurized dispensing system according to claim 1, wherein the first section extends less than half of a length of the crimp ring in the axial direction, and the second section extends more than half of the length of the crimp ring in the axial direction.

7. The pressurized dispensing system according to claim 1, wherein the at least one slot includes two to four slots that are provided in the crimp ring.

8. A plastic bottle including:

(a) a base at a bottom end of the bottle;

(b) a body extending about an axis of the bottle from the base towards a top end of the bottle; and (c) a finish extending about the axis of the bottle from the body to the top end of the bottle, wherein the finish includes:

(i) a crimp ring extending outwardly from an adjacent surface of the finish, the crimp ring forming an upper surface of the bottle and an outer surface of the bottle;

(ii) a first sealing projection extending from the upper surface; and (iii) a second sealing projection extending from the upper surface, the second sealing projection being positioned a further distance from the axis of the bottle than the first sealing projection is positioned from the axis of the bottle, wherein at least one slot extends inwardly from the outer surface, the at least one slot including a first section adjacent to the upper surface, with a surface of the bottle in the first section being a further distance from the axis of the bottle than the second sealing projection is positioned from the axis of the bottle, and the at least one slot including a second section below the first section, with a surface of the bottle in the second section being continuous with the adjacent surface of the finish.

* * * * *